US011585108B2

(12) United States Patent
Eckhardt et al.

(10) Patent No.: US 11,585,108 B2
(45) Date of Patent: Feb. 21, 2023

(54) LIFEGUARD OBSERVATION STATION

(71) Applicant: Aqua Conscience Holdings LLC, Lancaster, PA (US)

(72) Inventors: Bartley J. Eckhardt, Landisville, PA (US); Bret W. Johnson, Lancaster, PA (US)

(73) Assignee: Aqua Conscience Holdings LLC, Lancaster, PA (US)

( * ) Notice: Subject to any disclaimer, the term of this patent is extended or adjusted under 35 U.S.C. 154(b) by 5 days.

(21) Appl. No.: 16/905,220

(22) Filed: Jun. 18, 2020

(65) Prior Publication Data

US 2020/0399918 A1 Dec. 24, 2020

Related U.S. Application Data

(60) Provisional application No. 62/865,341, filed on Jun. 24, 2019.

(51) Int. Cl.

| | |
|---|---|
| ***E04H 1/12*** | (2006.01) |
| ***E04B 1/34*** | (2006.01) |
| ***E04F 11/032*** | (2006.01) |

(52) U.S. Cl.

CPC ..... *E04H 1/1205* (2013.01); *E04B 1/3412* (2013.01); *E04F 11/032* (2013.01)

(58) Field of Classification Search

CPC .... E04H 1/1205; E04B 1/3412; A01M 31/02; E04F 11/032

See application file for complete search history.

(56) References Cited

U.S. PATENT DOCUMENTS

| | | | | |
|---|---|---|---|---|
| 348,908 | A * | 9/1886 | Horrocks | E04F 11/032 52/187 |
| 424,533 | A * | 4/1890 | Belles | E04F 11/032 52/187 |
| 839,846 | A * | 1/1907 | Holden | E04F 11/032 52/187 |
| 1,031,645 | A * | 7/1912 | Haskell | E04F 11/032 52/187 |
| 1,229,482 | A * | 6/1917 | Leclair | E04F 11/032 52/187 |
| 1,446,454 | A * | 2/1923 | Fischer | E04F 11/032 52/187 |

(Continued)

OTHER PUBLICATIONS

Tom Griffiths, Griff's Guard Station Spec Sheet, 2011, p. 1-2, aquaticsafetygroup.com.

*Primary Examiner* — Gisele D Ford

(74) *Attorney, Agent, or Firm* — Potomac Law Group, PLLC; Bruce Wolstoncroft

(57) ABSTRACT

A lifeguard observation station having a support structure, a platform member and stairs. The platform member is supported by the support structure and is elevated from ground level. The platform member has a first side, with at least a portion of the first side of the platform member being configured to be positioned proximate to or in-line with an edge of a pool or body of water. The stairs extend between the ground level and the platform member. The support structure is offset from the stairs. The lifeguard observation station provides a lifeguard unimpaired line-of-sight to swimmers or bathers in the pool or body of water whether when the lifeguard is positioned on the platform member or on the stairs.

15 Claims, 4 Drawing Sheets

(56) References Cited

U.S. PATENT DOCUMENTS 1,774,582 A * 9/1930 Woodbridge ..... E04F 11/032 52/187
3,491,498 A * 1/1970 Hughes, Jr. ..... E04F 11/032 52/187
3,513,547 A * 5/1970 Abraham ..... E04F 11/108 52/187
3,673,752 A * 7/1972 Allen ..... E04F 11/032 52/187
3,686,806 A * 8/1972 Verderio ..... E04F 11/032 52/187
3,727,360 A * 4/1973 Ollman ..... E04F 11/032 52/187
3,740,906 A * 6/1973 Schneider ..... E04F 11/032 52/187
3,916,591 A * 11/1975 Agterhof ..... E04F 11/032 52/187
3,964,222 A * 6/1976 Geleijnse ..... E04F 11/032 52/187
4,128,976 A * 12/1978 Classen ..... E04F 11/032 52/187
4,338,751 A * 7/1982 Sanders ..... E04F 11/032 52/187
4,527,367 A * 7/1985 Morellini ..... E04F 11/032 52/187
4,587,780 A * 5/1986 Rorke ..... E04F 11/032 182/92
4,722,374 A * 2/1988 Bond ..... E04F 11/032 144/345
4,850,164 A * 7/1989 McLeod ..... E04F 11/032 52/182
4,897,972 A 2/1990 Stollery
5,535,557 A * 7/1996 Garber ..... E04F 11/032 52/182
5,632,124 A * 5/1997 Weingarten ..... E04F 11/032 182/187
5,737,884 A * 4/1998 Schrom ..... E04F 11/032 52/182
5,983,580 A * 11/1999 Carr ..... E04F 11/032 52/182
6,108,988 A * 8/2000 Nagelski ..... A63B 9/00 182/48
6,637,549 B1 10/2003 Lopacki
7,913,460 B2 3/2011 Stollery
8,281,525 B2 * 10/2012 Driscoll ..... E04F 11/1834 52/187
D726,341 S 4/2015 Vitolo
D782,065 S 3/2017 Vitolo
9,803,368 B1 * 10/2017 Stehl ..... E04F 11/104
2007/0199258 A1 * 8/2007 Reeves ..... E04F 11/0255 52/183
2008/0236066 A1 * 10/2008 Arnold ..... E04F 11/032 52/187
2009/0094907 A1 * 4/2009 Denicolo ..... E04F 11/032 52/188
2011/0192099 A1 * 8/2011 Driscoll ..... E04F 11/032 52/187
2011/0258946 A1 * 10/2011 Scherma ..... E04F 11/032 52/187
2017/0241142 A1 * 8/2017 Catt ..... E04F 11/032
2017/0342719 A1 * 11/2017 Seo ..... E04F 11/032

* cited by examiner

LIFEGUARD OBSERVATION STATION

FIELD OF THE INVENTION

The present invention relates generally to an observation platform for use by a lifeguard at a swimming pool or beach. More particularly, the invention is directed to an observation platform which provides maximum visibility of swimmers or bathers when a lifeguard is positioned on the platform and when the lifeguard is exiting the platform.

BACKGROUND OF THE INVENTION

Lifeguard chairs are used at pools and beaches to allow a lifeguard to sit and observe individuals swimming or recreating in or near the water. Generally, a lifeguard chair includes a raised platform with a seat attached thereto. The seat allows the user to be positioned approximately 4 to 10 feet above the ground. A ladder may be used as part of the chair to allow the lifeguard to access the seat.

In some uses, the lifeguard chair is permanently affixed to the ground. For smaller pools and other environments, however, the lifeguard chair is portable. A frame of the lifeguard chair supports the chair and generally has a sufficiently wide base to provide support on the pool deck or other surface.

In general, lifeguard chairs are configured to provide a chair at the top of a ladder or stairs. Such configurations allow for little or no ability for the lifeguard to stand or move relative to the chair, thereby limiting the ability of the lifeguard to properly observe the individual swimmers in all locations of the pool or body of water. In addition, the positioning of the chair is often set back from the edge of the pool or body of water, as room is required for the stairs. Consequently, as the chair and the lifeguard are removed from the edge of the pool or body of water, the lifeguard's line of site is not optimized, leaving areas of the pool or body of water not visible to the lifeguard.

Another problem with many lifeguard chairs is that they can tip over in high winds. A falling chair can be dangerous for a lifeguard using the chair or for individuals around the chair if no lifeguard is in the chair when the chair falls over. In addition, the chair may be damaged if it tips over in the wind.

It would be beneficial to provide a lifeguard observation station which can be positioned at the edge of the pool or body of water and which provides the lifeguard with maximum visibility of swimmers or bathers when positioned on the platform. It would also be beneficial to provide the lifeguard with maximum visibility of swimmers or bathers when the lifeguard is exiting the platform, thereby allowing the lifeguard to maintain a line-of-sight to any swimmer or bather in distress. It would also be beneficial to provide a lifeguard observation station which is portable and stable.

SUMMARY OF THE INVENTION

An object of the invention is to provide a lifeguard observation station which provides the lifeguard with maximum visibility of the swimmers or bathers in a pool to prevent drowning incidents.

An embodiment is directed to a lifeguard observation station having a support structure, a platform member and stairs. The platform member is supported by the support structure and is elevated from ground level. The platform member has a first side, with at least a portion of the first side of the platform member being configured to be positioned proximate to or in-line with an edge of a pool or body of water. The stairs extend between the ground level and the platform member. The support structure is offset from the stairs. The lifeguard observation station provides a lifeguard unimpaired line-of-sight to swimmers or bathers in the pool or body of water whether when the lifeguard is positioned on the platform member or on the stairs.

An embodiment is directed to a lifeguard observation station with a support structure. A platform member is supported by the support structure. The platform member is elevated from ground level. The platform member has a first side and a second side, with at least a portion of the first side of the platform member being configured to be positioned proximate to or in-line with an edge of a pool or body of water. Stairs extend from the second side of the platform member. The stairs extend between the ground level and the platform member. A bottom stair of the stairs has a longitudinal axis which is essentially parallel to the edge pool or body of water at which the lifeguard observation station member is positioned and essentially parallel to the portion of the first side of the platform member configured to be positioned proximate to or in-line with the edge of the pool or body of water.

An embodiment is directed to a modular lifeguard observation station. The lifeguard observation station includes a base member with a lower portion of a staircase secured thereto. The base member has an upwardly projecting securing member. The lifeguard observation station also includes a platform member with an upper portion of the staircase secured thereto. The platform member has a downwardly projecting securing member. The upwardly projecting securing member of the base member cooperates with the downwardly projection securing member of the platform member to allow the platform member to be properly secured by the base member. The lower portion of the staircase and the upper portion of the staircase form a continuous staircase when the upwardly projecting securing member of the base member cooperates with the downwardly projection securing member of the platform member.

An embodiment is directed to a lifeguard observation station having a base member, a platform member, stairs and a support member. The platform member is positioned above the base member. The platform member has a first side, with at least a portion of the first side of the platform member being configured to be positioned proximate to or in-line with an edge of a pool or body of water. The stairs extend between the base member and the platform member. The support member extends between the base member and the platform member. The support member is offset from the stairs to allow a lifeguard using the stairs to have unobstructed line-of-sight of the pool or body of water.

An embodiment is directed to a lifeguard observation station having a base member and a platform member. The platform member is positioned above the base member. The platform member has a first side and a second side, with at least a portion of the first side of the platform member being configured to be positioned proximate to or in-line with an edge of a pool or body of water. Stairs extend from the second side of the platform member. The stairs extend between the base member and the platform member. A bottom stair of the stairs has a longitudinal axis which is essentially parallel to the edge pool or body of water at which the lifeguard observation station member is positioned.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
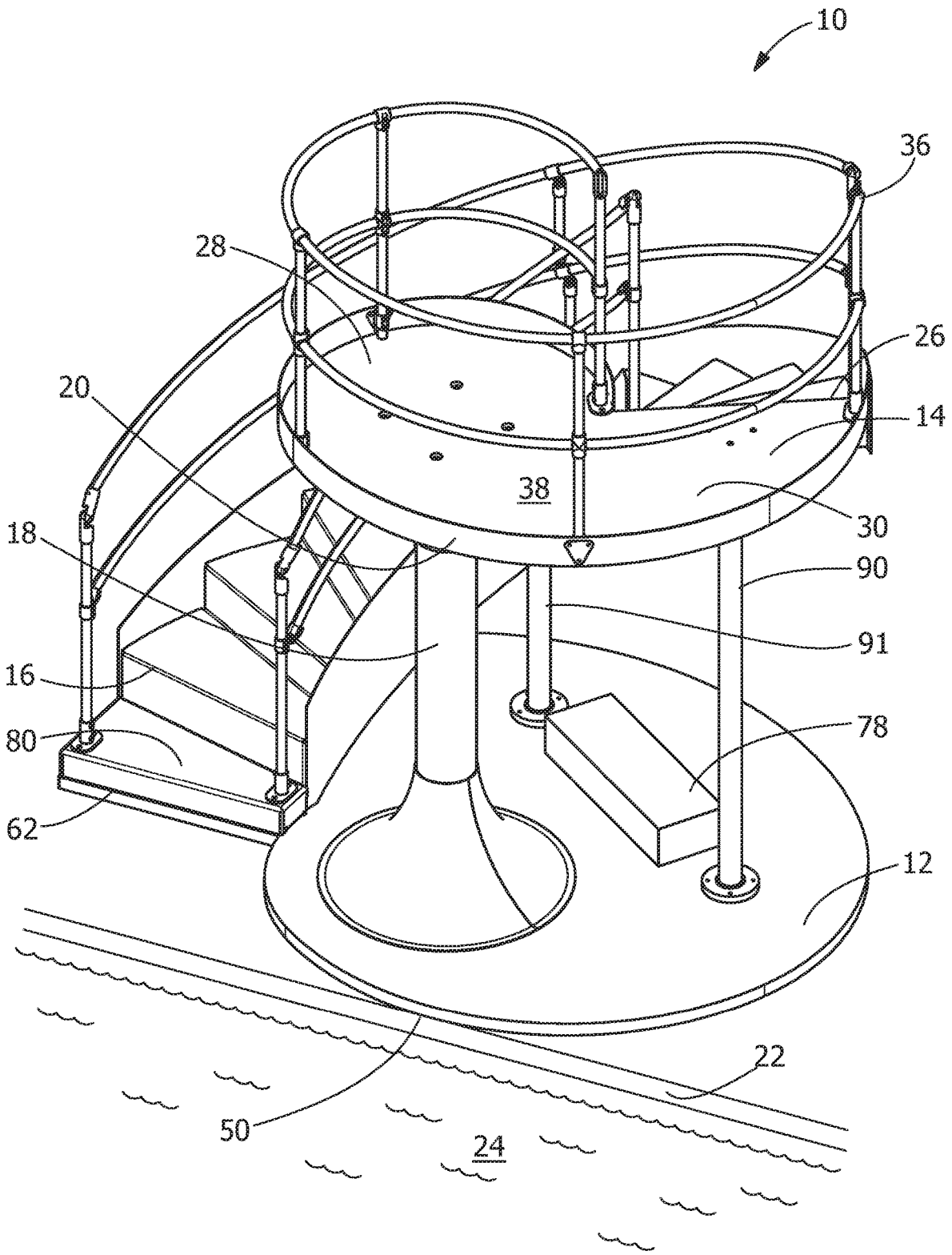
FIG. 1 is a front perspective view of an illustrative embodiment of a lifeguard observation station positioned proximate an edge of a pool or body of water.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features, the scope of the invention being defined by the claims appended hereto.

As shown in FIGS. 1-7, an illustrative embodiment of a lifeguard observation station 10 according to the present invention has a base member 12, a platform member 14, stairs 16 and a support member 18. The platform member 14 is positioned above the base member 12.

The platform member 14 has a first side 20, with at least a portion of the first side 20 of the platform member 14 being configured to be positioned proximate to or in-line with an edge 22 of a pool or body of water 24. The platform member 14 has a second side 26 from which the stairs 16 extend. In the embodiment shown, the second side 26 is opposed to the first side 20. However, the second side 26 may be positioned at different orientations relative to the first side 20, allowing the stairs to extend from other directions of the platform member 14.

Figure 5:
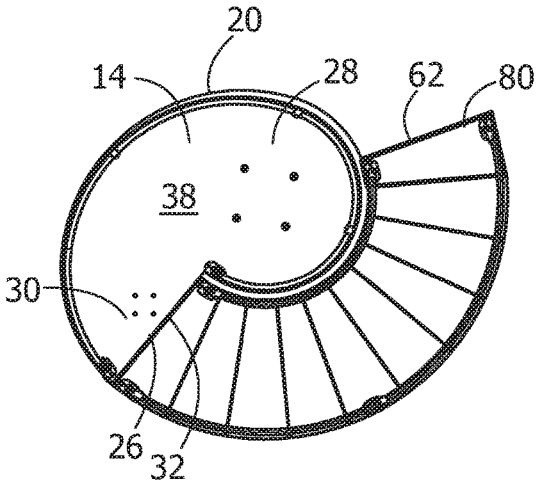
FIG. 5 is a top view of the lifeguard observation station of FIG. 1.
Figure 6:
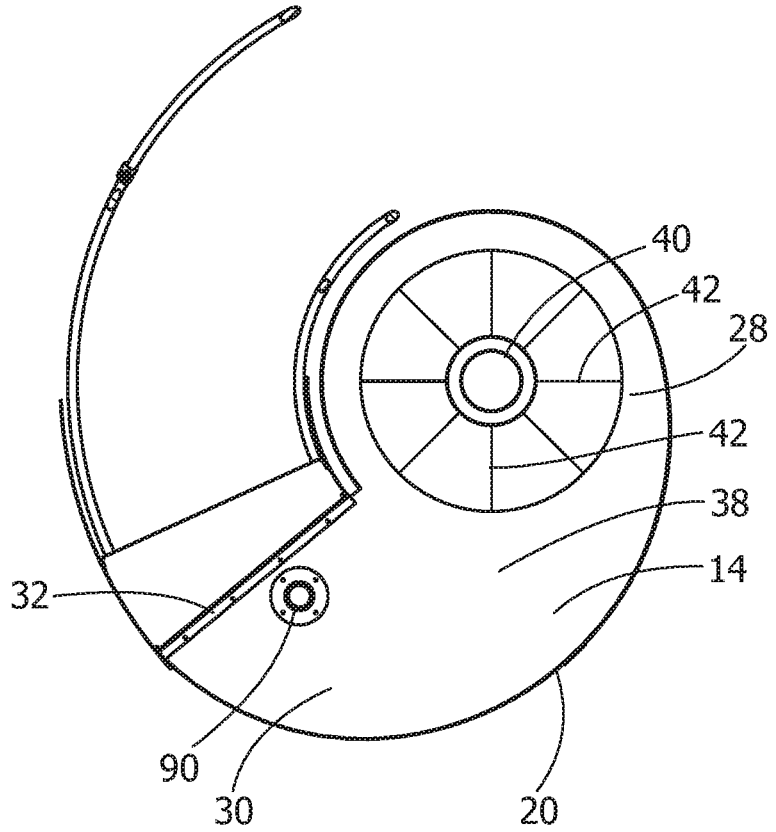
FIG. 6 is cross-section view of the lifeguard observation station taken along line 6-6 of FIG. 3.

In the embodiment shown, the platform member 14 has a volute shape, as best viewed in FIG. 5. The volute shape allows the platform member 14 to have a generally circular or elliptical portion 28 with an extension portion 30 extending from the circular or elliptical portion 28. The extension portion 30 has a generally straight surface 32 from which the stairs 16 extend.

A chair (not shown) may be provided on the platform member 14 to allow a lifeguard positioned in the lifeguard observation station 10 to be seated. The chair may be, but is not limited to, a swivel chair or a lean chair. The chair may be positioned proximate the center of the circular or elliptical portion 28. However, in other embodiments, no chair or more than one chair may be provided.

The circular or elliptical portion 28 of the platform member 14 has a sufficient surface area to allow the lifeguard to move about the platform member 14 to allow the lifeguard to acquire an optimum line-of-sight to the pool or body of water 24.

The platform member 14 has a railing 36 provided about the circumference thereof. The railing 36 does not extend across the straight surface 32 of the second side 26, thereby allowing the lifeguard to access the stairs 16 which extend from the straight surface 32. The railing 36 is of sufficient height to prevent the lifeguards from falling from the platform member 14. In addition, the railing 36 is constructed in a manner to provide sufficient safety support while providing unobstructed line-of-sight of the pool or body of water 24.

Figure 2:
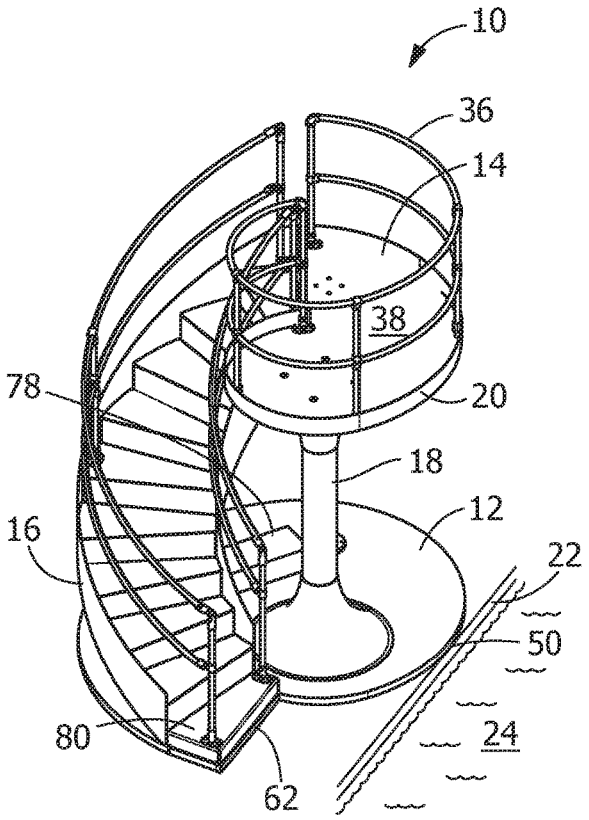
FIG. 2 is a side perspective view of the lifeguard observation station of FIG. 1 positioned proximate an edge of a pool or body of water.

As previously stated, at least a portion of the first side 20 of the platform member 14 is configured to be positioned proximate to or in-line with an edge 22 of a pool or body of water 24, as best shown in FIGS. 1 and 2. This allows the lifeguard to have a line-of-sight of the pool or body of water 24, including directly at the edge 22 of a pool or body of water 24, eliminating the blind spot at the edge 22 of a pool or body of water 24 associated with known lifeguard stations.

The positioning of lifeguards is a critical factor that contributes to lifeguard effectiveness in preventing injuries and responding to drownings at public swimming pools and water parks. If the lifeguards cannot see all of the bathers in the water, the lifeguards cannot effectively supervise and protect the bathers. The Lifesaving Society's Public Aquatic Facility Safety Standards state: "The supervision position(s) of lifeguards must be designed to eliminate blind spots in the pool area. It must be possible for the lifeguard team to observe all bathers in the pool area."

As the proper number and positioning of lifeguards has a significant potential to reduce the risk of drowning, the lifeguard observation station is configured to allow the platform member 14 to be positioned in-line with the edge 22 of the pool or body of water 24 to provide the lifeguards with proper views of the pool, including the edge 22 of a pool or body of water 24 proximate to which the lifeguard observation station 10 is positioned.

The platform member 14 has a platform or deck 38 upon which the lifeguard is positioned. As viewed in FIG. 6, a securing member or support post 40 extends from the deck 38. Reinforcing members 42 extend radially from the support post 40 to provide sufficient support to the deck 38 to support one or more lifeguards. The support post 40 and reinforcing members 42 can be made from any material having the strength characteristics required to support the deck 38 and lifeguards. While the support post 40 and reinforcing members 42 form a generally conical configuration, other configurations of the support post 40 and reinforcing members 42 can be used without departing from the scope of the invention.

The base member 12 has a first side 50, with at least a portion of the first side 50 of the base member 12 being configured to be positioned proximate to or in-line with the edge 22 of the pool or body of water 24. In the illustrative embodiment shown, the stairs 16 also extend from a portion of the first side 50 of the base member 12. However, other configurations, in which the stairs extend from other sides and other directions of the base member 12 may be used without departing from the scope of the invention.

Figure 7:
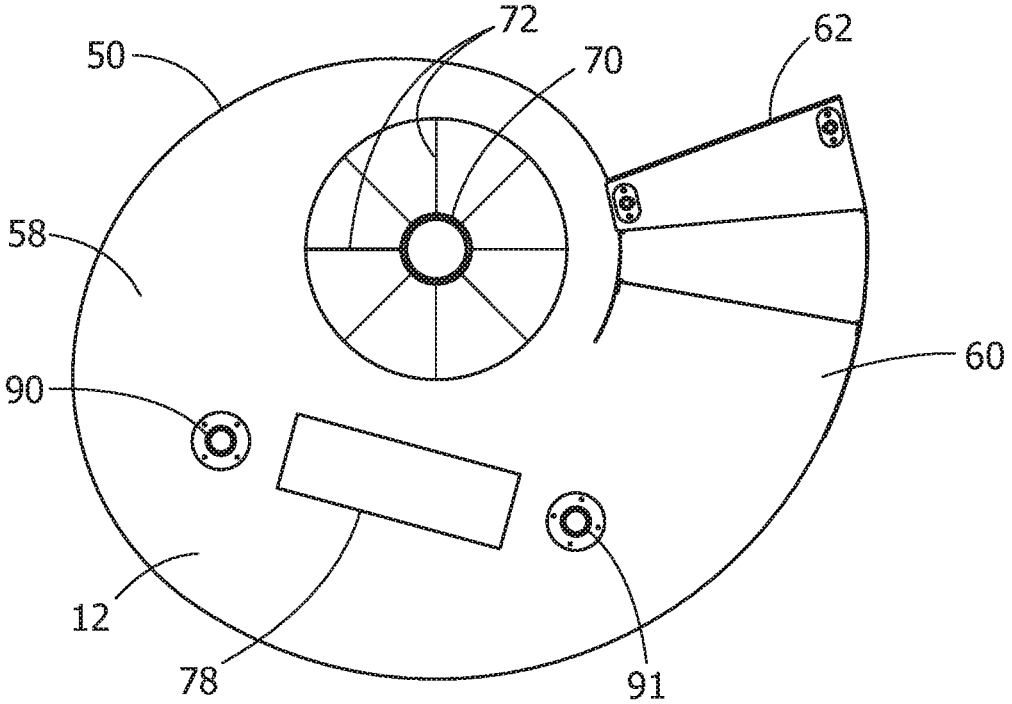
FIG. 7 is cross-section view of the lifeguard observation station taken along line 7-7 of FIG. 4.

In the embodiment shown, the base member 12 has a volute shape, as best viewed in FIG. 7. The volute shape allows the base member 12 to have a generally circular or elliptical portion 58 with an extension portion 60 extending from the circular or elliptical portion 58. The extension portion 60 has a generally straight surface 62 from which the stairs 16 extend. The straight surface 62 extends in a plane which is essentially parallel to a plane of the edge 22 of the pool or body of water 24 which is proximate to the lifeguard observation station 10. While the base member 12 is positioned below the platform 24, the volute shape of the base member 12 and the straight surface 62 of the base member 12 are not position in-line with the volute shape of the platform 14 and the straight surface 32 of the platform 14.

The base member 12 has a larger surface area than the surface area of the platform member 14, allowing the base member 12 to properly support and provide stability to the platform member 14 and stairs 16 to allow the lifeguard to move about the platform member 14 without causing the platform to tip or become unstable.

The first side 50 of the base member 12 is configured to be positioned in-line or offset from the first side 20 of the platform member 14 in a direction away from the edge 22 of the pool or body of water 24. This allows the first side 20 of the platform member 14 to be positioned proximate to or in-line with the edge 22 of the pool or body of water 24, as previously described and as best shown in FIG. 1.

Figure 3:
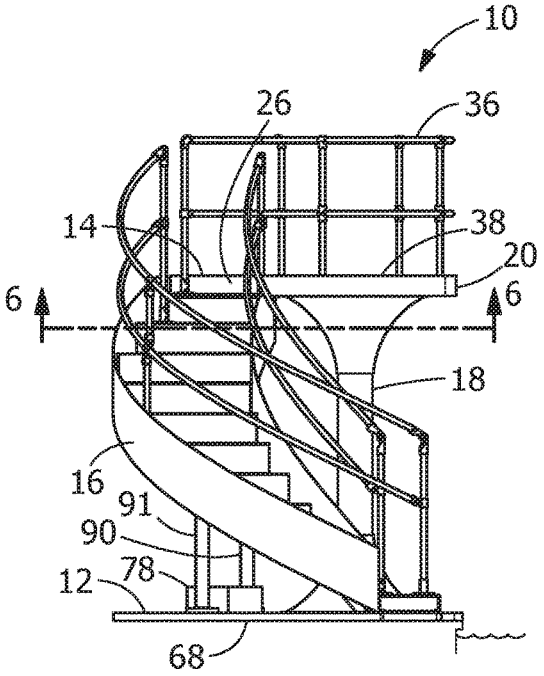
FIG. 3 is a side view of the lifeguard observation station of FIG. 1.
Figure 4:
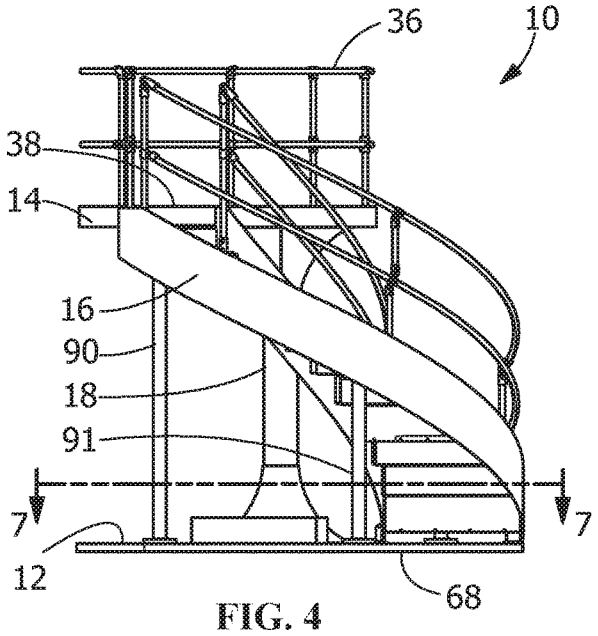
FIG. 4 is back view of the lifeguard observation station of FIG. 1.

Referring to FIGS. 3 and 4, the base member 12 has a bottom platform 68 which is configured to be positioned on the ground or pool deck. As best shown in FIG. 7, a securing member or support post 70 extends from the bottom platform 68. Strengthening members 72 extend radially from the support post 70 to the bottom platform 68 to provide sufficient support to the post 70. The support post 70 and strengthening members 72 provide sufficient support to stabilize the platform member 14 and support one or more lifeguards positioned thereon. The support post 70 and strengthening members 72 can be made from any material having the strength characteristics required to stabilize the platform member 14 and the lifeguard observation station 10. While the support post 70 and strengthening members 72 form a generally conical configuration, other configurations of the support post 70 and strengthening members 72 can be used without departing from the scope of the invention.

Wheels (not shown) may be provided on the bottom platform 68 of the base member 12 to facilitate the movement of the base member 12 and the lifeguard observation station 10 to the proper position. The wheels may be spring loaded to allow the base member 12 to be moved or to be maintained in position when desired.

Additional weight or ballast(s) 78 may be added to the base member 12 to provide additional weight to further stabilize the base member 10 and the lifeguard observation station 10. One example of a ballast 78 is a hallow tank adapted to hold water or a similar liquid mass. Upon proper positioning of the base member 12, the ballast 78 may be filled to stabilize the lifeguard observation station 10.

The support member or post 18 extends between the base member 12 and the platform member, as shown in FIGS. 1 and 2. The support member is aligned with and in physical contact with the support post 40 of the platform member 14 and the support post 70 of the base member 12. The support member 18 can be a separate modular component of the lifeguard observation station 10 which connects to the modular base member 12 and the modular platform member 14. Alternatively, the support member 18 may be integrally attached to the support post 70 of the base member 12 and the support post 40 of the platform member 14. The support member 18 shown in the illustrative embodiment is a cylindrical pipe like member made of any material having the strength characteristics required to support the platform member 14 and stabilize the lifeguard observation station 10.

The support member 18 may be varied in size depending upon the height required for the deck 38 of the platform member 14. For example, in the embodiment shown in FIGS. 1-7, the support member 18 is longer in length than the support member 18 shown in FIG. 8.

Additional support members 90 may also extend between the platform member 14 and the base 12. The support members 90 provide additional support to the platform member 14 and stabilize the lifeguard observation station 10. In the embodiment shown, the additional support members 90 are cylindrical members with a smaller diameter than the diameter of the support post 18. However, other configurations of the of the support members 90 may be used without departing from the scope of the invention. The support members 90 can be made from any material having the strength characteristics required to stabilize the platform member 14.

The stairs 16 extend between the base member 12 and the platform member, as shown in FIGS. 1 and 2. The stairs 16 have a generally spiral configuration. The stairs 16 may be supported by the engagement of the stairs with the extension 60 of the base member 12 and the extension 30 of the platform member 14.

Additional support members 91 may also extend between the stairs 16 and the base 12. The support members 91 provide additional support to the stairs 16 and stabilize the lifeguard observation station 10. In the embodiment shown, the additional support members 91 are cylindrical members with a smaller diameter than the diameter of the support post 18. However, other configurations of the of the support members 91 may be used without departing from the scope of the invention. The support members 91 can be made from any material having the strength characteristics required to stabilize the stairs 16.

Figure 8:
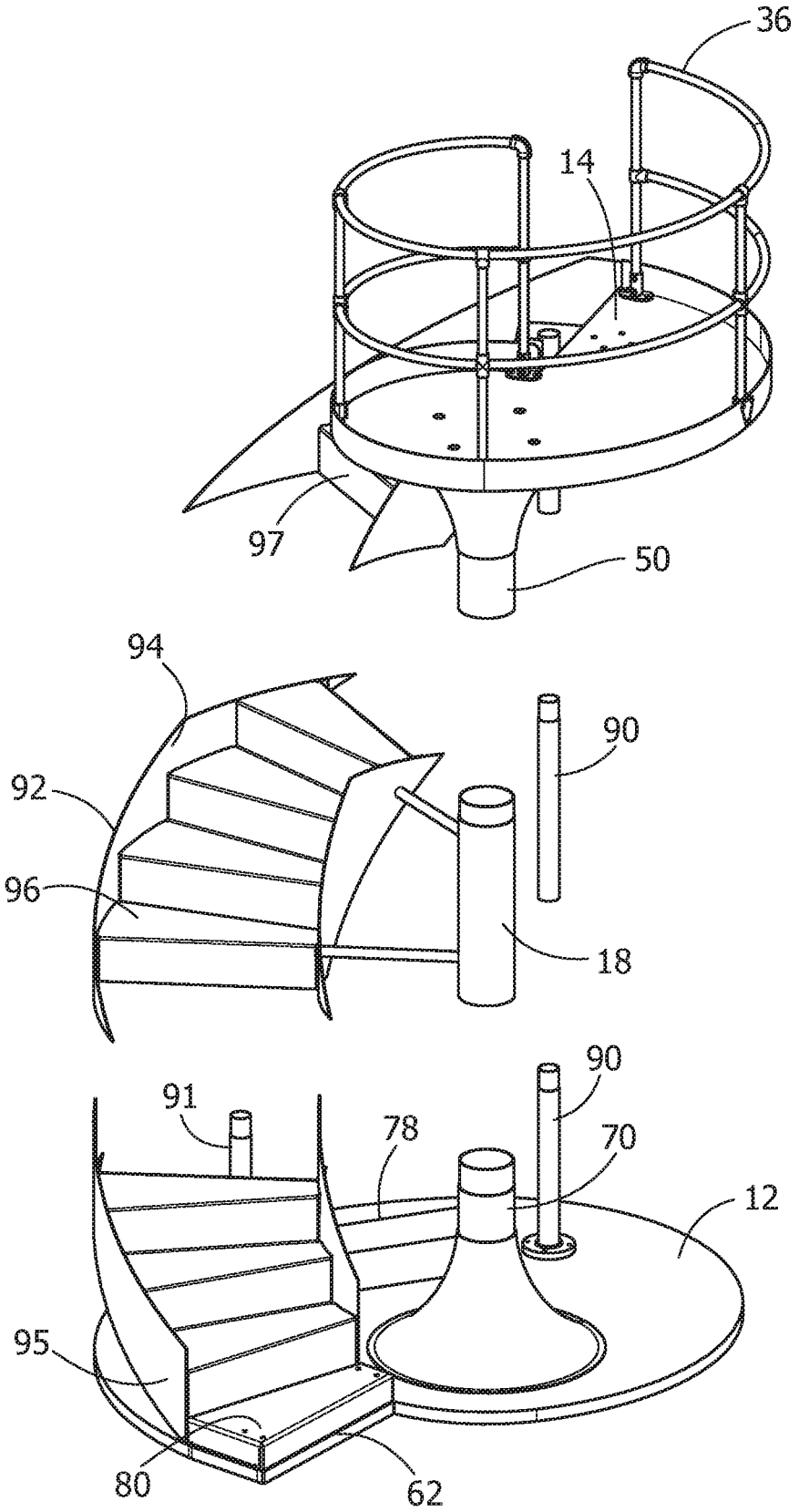
FIG. 8 is an exploded perspective view of a first alternate illustrative embodiment of a lifeguard observation station.

The stairs 16 may be of different height depending upon the overall height of the observation station 10. In addition, the stairs 16 may have modular sections which allow the height of the stairs 16 to be proportional to the height of the support post 18 which extends between the platform member 14 and the base member 12. In various embodiments, and as shown in FIG. 8, a riser section 92 is positioned between the base member 12 and the platform member 14, the riser section 92 has an intermediate portion 96 of the stairs 16 secured to the support post 18. When the riser section 92 is positioned between the base member 12 and the platform member 14, the upwardly projecting securing member 70 of the base member 12 cooperates with the support post 18 and the downwardly projection securing member 50 of the platform member 14 cooperates with the riser support post 18 to allow the platform member 14 to be properly secured to the support post 18 of the riser section 92 and the support post 18 of the riser section 92 to be properly secured to the base member 12, causing a lower portion 95 of the stairs 16, the intermediate portion 96 of the stairs 16 and an upper portion 97 of the stairs 16 to form the continuous stair case.

A bottom stair 80 extends from the straight surface 62 of the extension 60 of the base member 12. A top stair 82 extends from the straight surface 32 of the extension 30 of the platform member 14. The bottom stair 80 is positioned such that a longitudinal axis or a longitudinal edge of the bottom stair 80 is essentially parallel to the edge 22 of the pool or body of water 24 at which the lifeguard observation station member is positioned.

When viewed from the edge 22 of the pool or body of water 24, the stairs 16 are offset from the support member 18 to allow a lifeguard using the stairs to have unobstructed line-of-sight of the pool or body of water 24 as the lifeguard descends the stairs 16 from the platform member 14.

Continuous and unimpaired observation of the pool or body of water 24 are critical as the lifeguard is descending from the deck 38 of the platform member 14 to the edge 22 of the pool or body of water 24. Such unimpaired line-of-sight can be critical to allow a lifeguard to maintain a continuous vision of an impaired swimmer.

While the invention has been described with reference to a preferred embodiment, it will be understood by those skilled in the art that various changes may be made and equivalents may be substituted for elements thereof without departing from the spirit and scope of the invention as defined in the accompanying claims. In particular, it will be clear to those skilled in the art that the present invention may be embodied in other specific forms, structures, arrangements, proportions, sizes, and with other elements, materials and components, without departing from the spirit or essential characteristics thereof. One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

We claim:

1. A movable lifeguard observation station comprising:

a movable weighted base, the movable weighted base having wheels to facilitate the movement of the lifeguard observation station, the movable weighted base configured to stabilize the movable lifeguard observation station;

a support structure extending from the movable weighted base;

a platform member supported by the support structure, the platform member being elevated from ground level, the platform member having a first side and a second side which is spaced from the first side, at least a portion of the first side of the platform member extending beyond the weighted base, the portion of the first side of the platform member being configured to be positioned in-line with an edge of a pool or body of water;

stairs extending between the ground level and the platform member, the stairs have a spiral configuration, a top stair of the stairs extends from the second side of the platform member, a bottom stair of the stairs extends from the movable weighted base, the bottom stair has a longitudinal axis which is configured to be positioned parallel to the edge of the pool or body of water at which the lifeguard observation station member, the bottom stair configured to be positioned proximate the edge of the pool or body of water and extending essentially parallel to the portion of the first side of the platform member configured to be positioned proximate to or in-line with the edge of the pool or body of water;

the support structure is offset from the stairs;

wherein the lifeguard observation station is configured to provide unimpaired line-of-sight to swimmers or bathers in the pool or body of water from the platform member or the stairs.

2. The lifeguard observation station as recited in claim 1, wherein the platform member has a volute shape.

3. The lifeguard observation station as recited in claim 2, wherein the support structure extends from the movable weighted base to the platform member, the movable weighted base has a volute shape.

4. The lifeguard observation station as recited in claim 3, wherein the platform member has a railing provided about a circumference thereof, including on the first side of the platform member which is configured to be position proximate to or in-line with the edge of the pool or body of water.

5. The lifeguard observation station as recited in claim 4, wherein the movable weighted base has a ballast to provide additional stability to the lifeguard observation station.

6. The lifeguard observation station as recited in claim 3, wherein the support structure has a support member which is positioned between a downwardly projecting securing member of the platform member and an upwardly projecting securing member of the movable weighted base, the downwardly projecting securing member of the platform member having first strengthening members and the upwardly projecting securing member of the movable weighted base having second strengthening members.

7. The lifeguard observation station as recited in claim 1, wherein the support structure is a number of support members which extend between the platform member and movable weighted base.

8. The lifeguard observation station as recited in claim 7, wherein the support members are positioned proximate the perimeter of the platform member.

9. A movable lifeguard observation station comprising:

a movable weighted base member, the movable weighted base member having wheels to facilitate the movement of the lifeguard observation station, the movable weighted base member configured to stabilize the movable lifeguard observation station;

a support structure extending from the movable weighted base member;

a platform member supported by the support structure, the platform member being elevated from ground level, the platform member having a first side and a second side, with at least a portion of the first side of the platform member extending beyond the weighted base, the portion of the first side of the platform member being configured to be positioned proximate to or in-line with an edge of a pool or body of water;

stairs extending from the second side of the platform member, the stairs extending between the ground level and the platform member, a bottom stair of the stairs has a longitudinal axis which is configured to be positioned parallel to the edge of the pool or body of water, the bottom stair configured to be positioned proximate the edge of the pool and extending essentially parallel to the portion of the first side of the platform member configured to be positioned proximate to or in-line with the edge of the pool or body of water.

10. The lifeguard observation station as recited in claim 9, wherein the support structure is offset from the stairs, wherein the lifeguard observation station provides a lifeguard unimpaired line-of-sight to swimmers or bathers in the pool or body of water whether when the lifeguard is positioned on the platform member or on the stairs.

11. The lifeguard observation station as recited in claim 10, wherein the support structure includes an upwardly projecting securing member from the base member and a downwardly projecting securing member from the platform member, the upwardly projecting securing member of the base member cooperates with the downwardly projection securing member of the platform member to allow the platform member to be properly secured to the base member.

12. The lifeguard observation station as recited in claim 11, wherein a lower portion of the stairs is secured to the base member and an upper portion of the stairs is secured to the platform member, the lower portion of the stairs and the upper portion of the stairs form continuous stairs when the upwardly projecting securing member of the base member cooperates with the downwardly projection securing member of the platform member.

13. The lifeguard observation station as recited in in claim 12, wherein a riser section is positioned between the base member and the platform member, the riser section having an intermediate portion of the stairs secured thereto, the riser section having a riser securing member, wherein when the riser section is positioned between the base member and the platform member, the upwardly projecting securing member of the base member cooperates with the riser securing member and the downwardly projection securing member of the platform member cooperates with the riser securing member to allow the platform member to be properly secured to the riser section and the riser section to be properly secured to the base member, the lower portion of the stairs, the intermediate portion of the stairs and the upper portion of the stairs form the continuous stairs when the upwardly projecting securing member of the base member, the riser securing member and the downwardly projection securing member of the platform member cooperate.

14. The lifeguard observation station as recited in claim 11, wherein the platform member and the base member have volute shapes.

15. The lifeguard observation station as recited in claim 9, wherein the platform member has a railing provided about a circumference thereof, including on the first side of the platform member which is configured to be position proximate to or in-line with an edge of a pool or body of water.

* * * * *